US010214030B2

(12) United States Patent
Suzuki et al.

(10) Patent No.: US 10,214,030 B2
(45) Date of Patent: Feb. 26, 2019

(54) INK JET PRINTER

(71) Applicant: Roland DG Corporation, Hamamatsu-shi, Shizuoka (JP)

(72) Inventors: Hironobu Suzuki, Hamamatsu (JP); Takuro Kamiya, Hamamatsu (JP); Sachie Muroga, Hamamatsu (JP); Takayoshi Oguri, Hamamatsu (JP); Masanori Ishihara, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/922,952

(22) Filed: Mar. 16, 2018

(65) Prior Publication Data

US 2018/0290461 A1 Oct. 11, 2018

(30) Foreign Application Priority Data

Apr. 5, 2017 (JP) ..... 2017-075005

(51) Int. Cl.
*B41J 11/02* (2006.01)
*B41J 11/00* (2006.01)
*B41J 29/13* (2006.01)

(52) U.S. Cl.
CPC ..... *B41J 11/002* (2013.01); *B41J 11/02* (2013.01); *B41J 29/13* (2013.01)

(58) Field of Classification Search
CPC . B41J 11/002; B41J 11/02; B41J 29/13; B41J 3/28
USPC ..... 347/101, 102, 104, 108
See application file for complete search history.

(56) References Cited

U.S. PATENT DOCUMENTS

| | | | | |
|---|---|---|---|---|
| 6,714,229 | B2 * | 3/2004 | Miyazaki | B41J 29/13 347/223 |
| 7,207,670 | B2 * | 4/2007 | Silverbrook | B41J 11/002 347/102 |
| 9,925,779 | B2 * | 3/2018 | Shinbara | B41J 2/16535 |
| 2014/0375734 | A1 | 12/2014 | Takeuchi et al. | |
| 2015/0314616 | A1 | 11/2015 | Shinjo et al. | |
| 2016/0303846 | A1 | 10/2016 | Mondloch | |

FOREIGN PATENT DOCUMENTS

| | | | |
|---|---|---|---|
| JP | 4889059 | B2 | 2/2012 |
| JP | 2013-111750 | A | 6/2013 |
| JP | 2013-166271 | A | 8/2013 |
| JP | 2014-156128 | A | 8/2014 |
| JP | 2015-212026 | A | 11/2015 |

* cited by examiner

*Primary Examiner* — An H Do
(74) *Attorney, Agent, or Firm* — Keating & Bennett, LLP

(57) ABSTRACT

A printer includes a platen on which a recording medium is placed, an ink head movable in a main scanning direction and able to eject ink onto the recording medium, a cover disposed above and to at least a side of the platen and including an opening located downstream of the ink head in a subscanning direction, a front cover attached to the cover and able to open and close the opening, and an air blower disposed on the front cover.

11 Claims, 7 Drawing Sheets

INK JET PRINTER

CROSS REFERENCE TO RELATED APPLICATIONS

This application claims the benefit of priority to Japanese Patent Application No. 2017-075005 filed on Apr. 5, 2017. The entire contents of this application are hereby incorporated herein by reference.

BACKGROUND OF THE INVENTION

1. Field of the Invention

The present invention relates to an ink jet printer.

2. Description of the Related Art

An ink jet recording device (hereinafter referred to as an "ink jet printer") that has been known to date performs predetermined printing on a recording medium in an ink jet manner. The ink jet printer includes a platen on which a recording medium is placed and an ink head that ejects ink onto the recording medium placed on the platen. The ink ejected on the recording medium is dried so that an image is thereby formed on the recording medium.

For example, Japanese Patent No. 4889059 discloses a print heater provided with a platen, as a means for promoting drying of ink ejected onto a recording medium. As illustrated in FIG. 8, in a configuration known as another means for promoting drying of ink, an air blower 120 including a plurality of fans 110 for sending air toward ink ejected onto a recording medium 100 is disposed downstream of an ink head 130.

In an ink jet printer 150 including the air blower 120 as illustrated in FIG. 8, the relatively large air blower 120 is disposed ahead of a platen 160 (closer to an operator than the platen 160 is). Thus, when the operator places the recording medium 100 on the platen 160, the air blower 120 hinders placing of the recording medium 100.

SUMMARY OF THE INVENTION

Preferred embodiments of the present invention provide ink jet printers that reduce the size of an air blower that dries ink ejected onto a recording medium.

An ink jet printer according to a preferred embodiment of the present invention includes a platen on which a recording medium is placed; an ink head that is movable in a main scanning direction and ejects ink onto the recording medium; a conveyor that conveys the recording medium in a subscanning direction perpendicular or substantially perpendicular to the main scanning direction; a cover disposed above and to at least a side of the platen and including an opening located downstream of the ink head in the subscanning direction; a front cover that is attached to the cover and opens and closes the opening; and an air blower disposed on the front cover.

In an ink jet printer according to a preferred embodiment of the present invention, the air blower that supplies air to the recording medium placed on the platen is disposed on the front cover. The front cover is attached to the cover so as to cover and uncover the opening located downstream of the ink head in the subscanning direction. Thus, when an operator places the recording medium on the platen, the operator opens the front cover so that the air blower is able to move together with the front cover accordingly. In this manner, while the front cover is open, the air blower is not located downstream (forward) of the platen in the subscanning direction. Thus, the operator is able to place the recording medium on the platen without interruption of the air blower.

Preferred embodiments of the present invention provide ink jet printers that enable reduction in the size of the air blower that dries ink ejected onto the recording medium and reduce influence of the air blower on printing quality.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
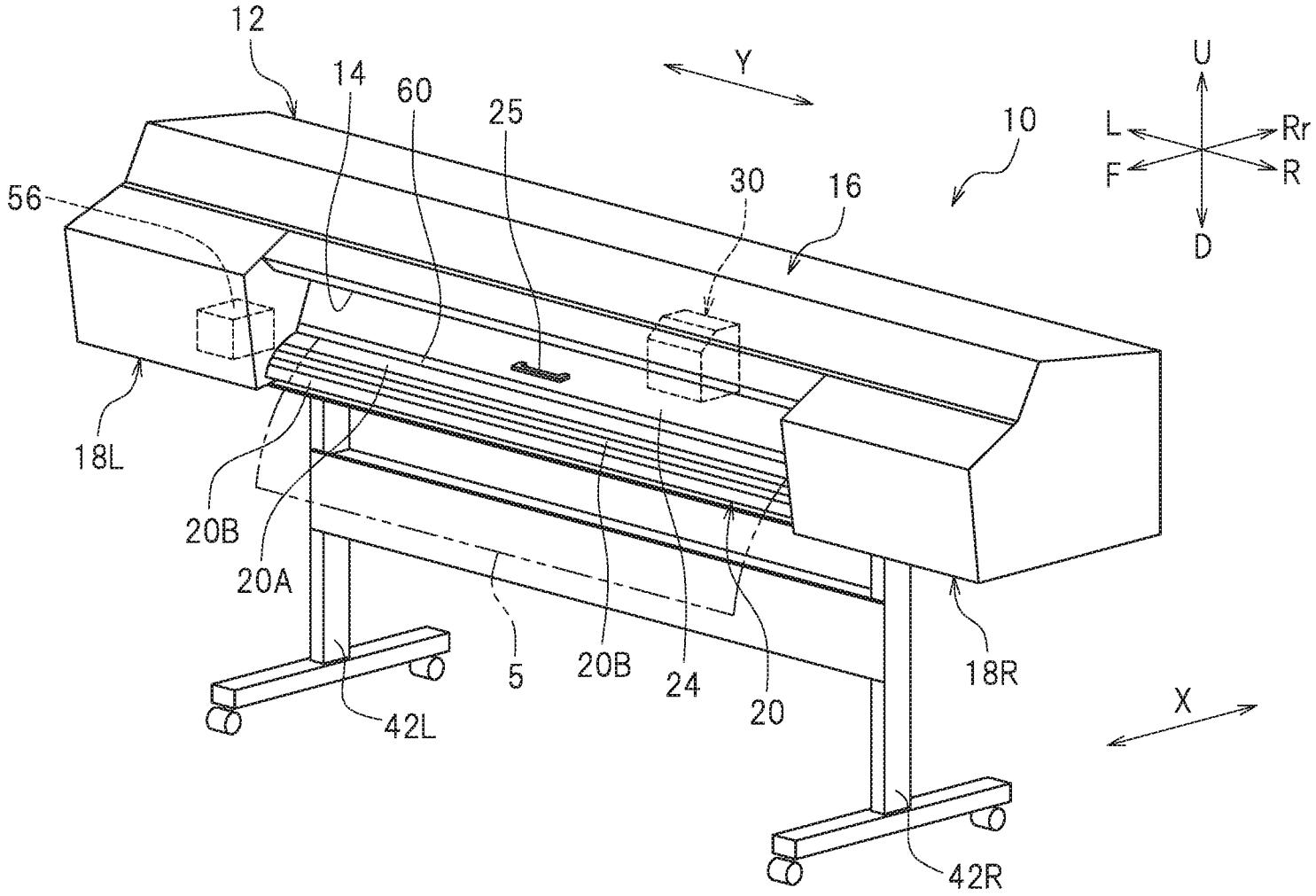
FIG. 1 is a perspective view illustrating an ink jet printer according to a preferred embodiment of the present invention.

Ink jet printers (hereinafter referred to as a printer 10) according to preferred embodiments will be described with reference to the drawings. The preferred embodiments described here are, of course, not intended to particularly limit the present invention. Elements and features having the same functions are denoted by the same reference numerals, and description for the same members and parts will not be repeated or will be simplified as appropriate.

FIG. 1 is a perspective view illustrating the printer 10 according to a preferred embodiment of the present invention. As illustrated in FIG. 1, the printer 10 performs printing on a recording medium 5. The recording medium 5 is, for example, a recording paper sheet. The recording medium 5, however, is not limited to the recording paper sheet. The recording medium 5 is not limited to paper such as plain paper or ink jet printing paper, and may be a sheet or a film made of a resin such as polyvinyl chloride or polyester, a fabric such as a woven fabric or a nonwoven fabric, or other media.

In the following description, left, right, up, and down respectively refer to left, right, up, and down seen from an operator at the front of the printer 10. The direction toward the operator from the printer 10 will be hereinafter referred to as forward, and the opposite direction away from the operator will be hereinafter referred to as rearward. Characters F, Rr, L, R, U, and D in the drawings represent front, rear, left, right, up, and down, respectively. Character Y in the drawings represents a main scanning direction. In this preferred embodiment, the main scanning direction Y is a left-right direction. The main scanning direction Y is a transverse direction of the recording medium 5. Character X in the drawings represents a subscanning direction. The subscanning direction X is a direction intersecting with the main scanning direction Y (e.g., a direction perpendicular to the main scanning direction Y in plan view). In this preferred embodiment, the subscanning direction X is a front-rear direction. The subscanning direction X is a longitudinal direction of the recording medium 5. The directions described above, however, are defined only for convenience of description, and should not be restrictive.

As illustrated in FIG. 1, the printer 10 includes a cover 12, a platen 20, an ink head 30, a left leg 42L, a right leg 42R, and an air blower 60. The left leg 42L and the right leg 42R are attached to a lower portion of the platen 20. The left leg 42L and the right leg 42R support the platen 20.

Figure 2:
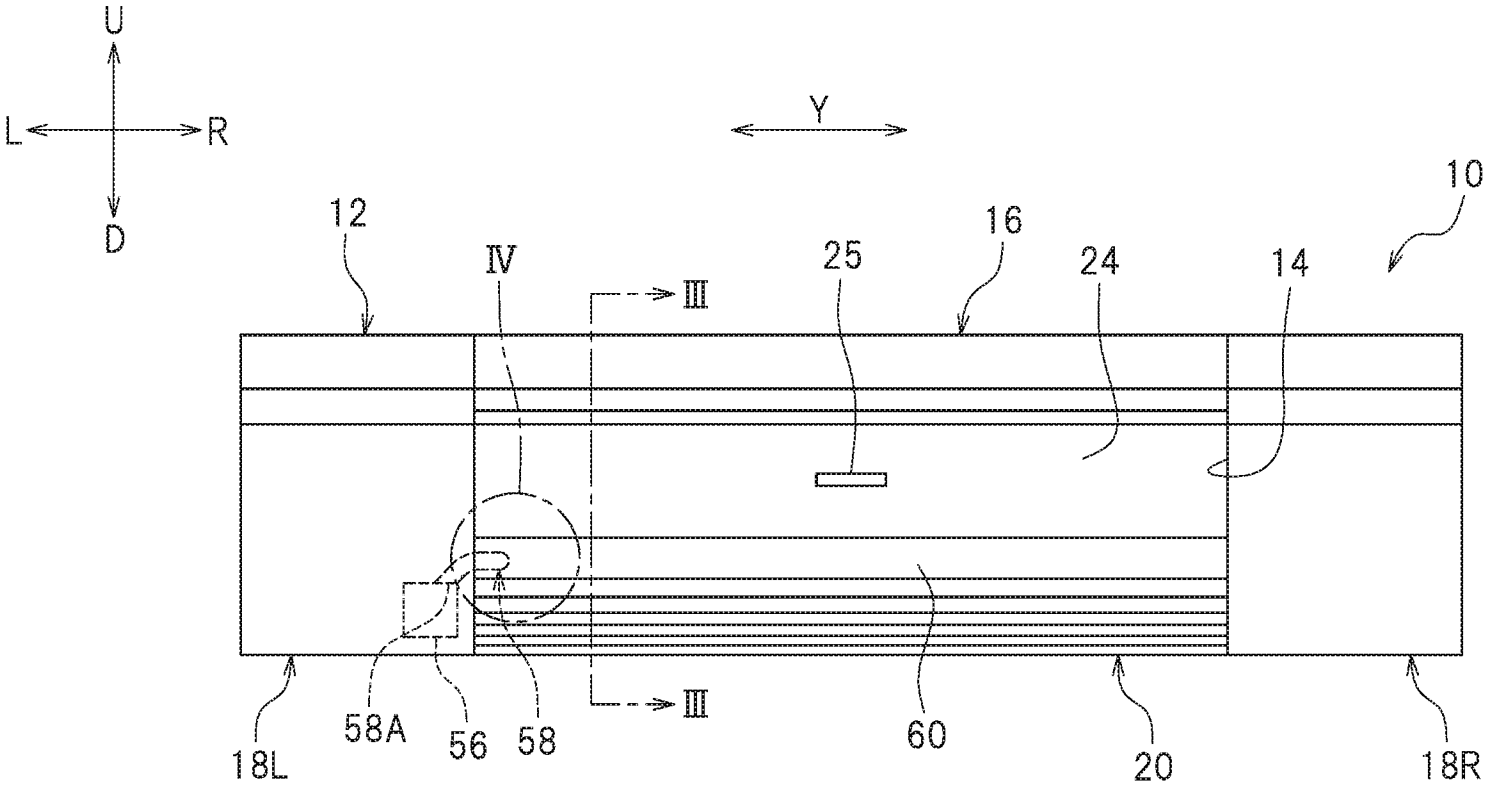
FIG. 2 is a front view illustrating a portion of an ink jet printer according to a preferred embodiment of the present invention.

As illustrated in FIG. 2, the cover 12 is disposed over the top and sides of the platen 20. The cover 12 includes an opening 14. The opening 14 is preferably located downstream of the ink head 30 in the subscanning direction X. The opening 14 is disposed ahead of the ink head 30. The cover 12 includes an upper cover 16, a left side cover 18L, and a right side cover 18R. The upper cover 16, the left side cover 18L, and the right side cover 18R define the opening 14. The upper cover 16 extends in the main scanning direction Y. The upper cover 16 is disposed above the platen 20. The upper cover 16 covers a portion of the platen 20 from above. The upper cover 16 is disposed above the ink head 30. The upper cover 16 is an example of a first cover portion. The left side cover 18L is disposed at the left of the platen 20. The left side cover 18L is disposed at the left of the upper cover 16. The right side cover 18R is located at the right of the platen 20. The right side cover 18R is located at the right of the upper cover 16. The left side cover 18L and the right side cover 18R are an example of a second cover portion. In FIG. 2, for convenience of description, the left leg 42L and the right leg 42R are not shown.

As illustrated in FIG. 1, the upper cover 16 is provided with a front cover 24 that is rotatable about the front end of the upper cover 16. The front cover 24 covers and uncovers the opening 14. The front cover 24 is made of an optically transmissive material. In this preferred embodiment, the front cover 24 is made of a transparent acrylic resin. The operator can see a printing status, for example, through the front cover 24. The front cover 24 is provided with a grip 25. The operator can pull the grip 25 forward to open the front cover 24.

Figure 3:
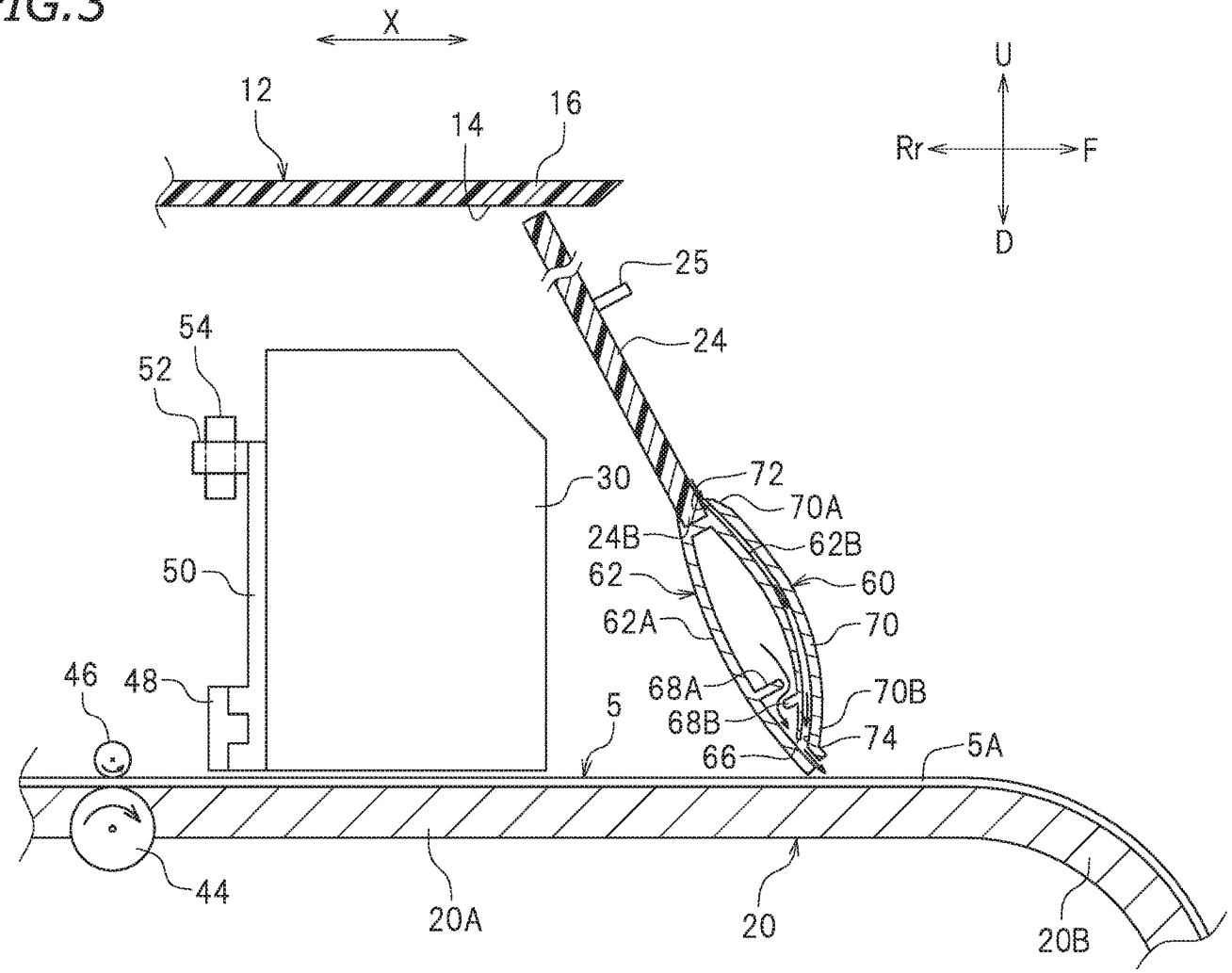
FIG. 3 is a cross-sectional view taken along line III-III in FIG. 2.

As illustrated in FIG. 1, the recording medium 5 is placed on the platen 20. The platen 20 supports the recording medium 5. The platen 20 extends in the main scanning direction Y. As illustrated in FIG. 3, the platen 20 includes a flat portion 20A and a curved portion 20B. The curved portion 20B is curved downward toward the front from the front edge of the flat portion 20A.

As illustrated in FIG. 3, the platen 20 is provided with a cylindrical grit roller 44. The grit roller 44 is buried in the platen 20 with the upper surface of the grit roller 44 being exposed. The grit roller 44 is driven by a feed motor (not shown). The grit roller 44 moves the recording medium 5 in the subscanning direction X. The grit roller 44 is an example of a conveyor.

A pinch roller 46 is disposed above the grit roller 44. The pinch roller 46 faces the grit roller 44. The pinch roller 46 is structured and disposed in such a manner that the position of the pinch roller 46 in the top-bottom direction is set depending on the thickness of the recording medium 5. The pinch roller 46 presses the recording medium 5. The recording medium 5 is pinched between the pinch roller 46 and the grit roller 44. The grit roller 44 and the pinch roller 46 convey the recording medium 5 in the subscanning direction X while pinching the recording medium 5 therebetween. Although FIG. 3 shows one grit roller 44 and one pinch roller 46, a plurality of grit rollers 44 and a plurality of pinch rollers 46 may be provided in an actual configuration.

As illustrated in FIG. 3, a guide rail 48 is disposed inside the cover 12. The guide rail 48 is disposed above the platen 20. The guide rail 48 is disposed in parallel or substantially in parallel with the platen 20. The guide rail 48 extends in the main scanning direction Y. The guide rail 48 is engaged with a carriage 50.

As illustrated in FIG. 3, a belt 52 is disposed inside the cover 12. The belt 52 extends in the main scanning direction Y. The belt 52 is an endless belt. A pulley 54 and a pulley (not shown) are respectively wound around the right end and the left end of the belt 52. The pulley 54 is coupled to a scanning motor (not shown) to drive the pulley 54. When the scanning motor rotates, the pulley 54 rotates, and the belt 52 travels in the main scanning direction Y.

As illustrated in FIG. 3, the carriage 50 is fixed to the belt 52. When the belt 52 travels, the carriage 50 moves in the main scanning direction Y along the guide rail 48.

As illustrated in FIG. 3, the ink head 30 is disposed above the platen 20. The ink head 30 includes a plurality of nozzles (not shown) to eject ink onto the recording medium 5. The ink head 30 is disposed on the carriage 50. When the carriage 50 moves in the main scanning direction Y, the ink head 30 moves the main scanning direction Y accordingly. The ink head 30 ejects ink toward the recording medium 5 while moving in the main scanning direction Y.

As illustrated in FIG. 1, the air blower 60 is disposed on the front cover 24. The air blower 60 is disposed at a lower end 24B (see FIG. 3) of the front cover 24. The air blower 60 supplies air toward a portion 5A of the recording medium 5 placed on the platen 20, and the portion 5A is located downstream (forward) of the front cover 24 in the subscanning direction X. The air blower 60 may supply air toward the recording medium 5 placed on the curved portion 20B of the platen 20. The air blower 60 may send air along the flat portion 20A and the curved portion 20B of the platen 20. The air blower 60 is made of, for example, an aluminum material. The air blower 60 supplies air while the opening 14 is closed by the front cover 24 (hereinafter referred to as "while the front cover 24 is closed"). While the front cover 24 is closed, a gap is present between the lower end of the air blower 60 and the surface of the recording medium 5. That is, the air blower 60 is not in direct contact with the recording medium 5.

As illustrated in FIG. 2, a fan 56 to supply air to the air blower 60 is disposed in the left side cover 18L. The fan 56 is connected to an unillustrated control device and is driven while the front cover 24 is closed. The fan is not limited to a specific configuration, and a conventionally known fan may be used.

Figure 5:
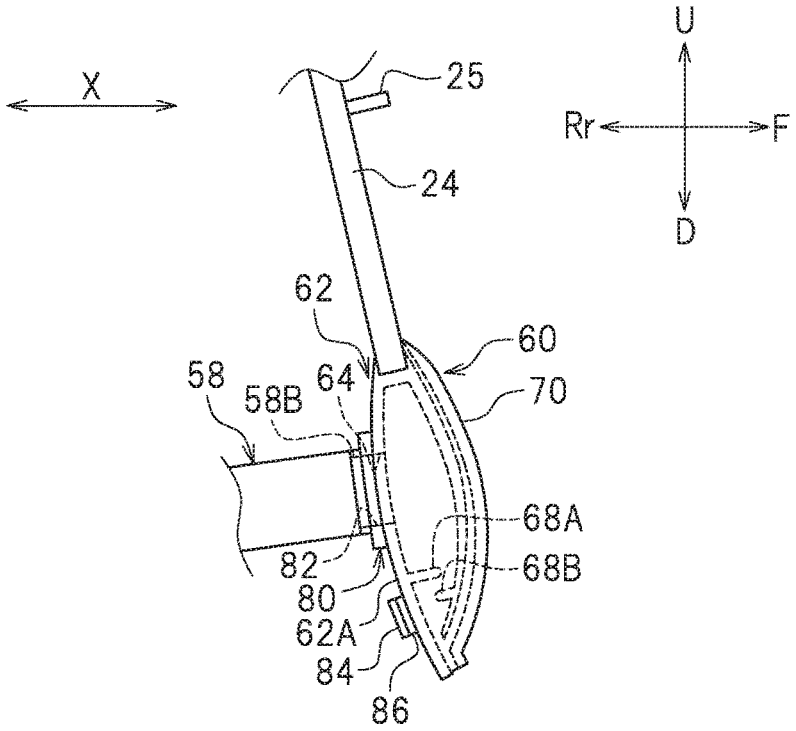
FIG. 5 is a side view illustrating a state in which a front cover according to a preferred embodiment of the present invention is closed.

As illustrated in FIG. 2, an air distribution pipe 58 is disposed in the cover 12. A portion of the air distribution pipe 58 is located in the left side cover 18L. Another portion of the air distribution pipe 58 is located below the upper cover 16. One end (first end) 58A of the air distribution pipe 58 is connected to the fan 56. Air supplied from the fan 56 flows in the air distribution pipe 58. As illustrated in FIG. 5, the other end (second end) 58B (see also FIG. 6) of the air distribution pipe 58 is connected to an air inlet 64 described later. Air supplied from the fan 56 is guided to the air inlet 64 through the air distribution pipe 58.

As illustrated in FIG. 3, the air blower 60 includes a body 62, the air inlet 64 (see FIG. 4), an air outlet 66, a first rib 68A, a second rib 68B, a covering portion 70, an air suction port 72, and an air discharge port 74.

Figure 4:
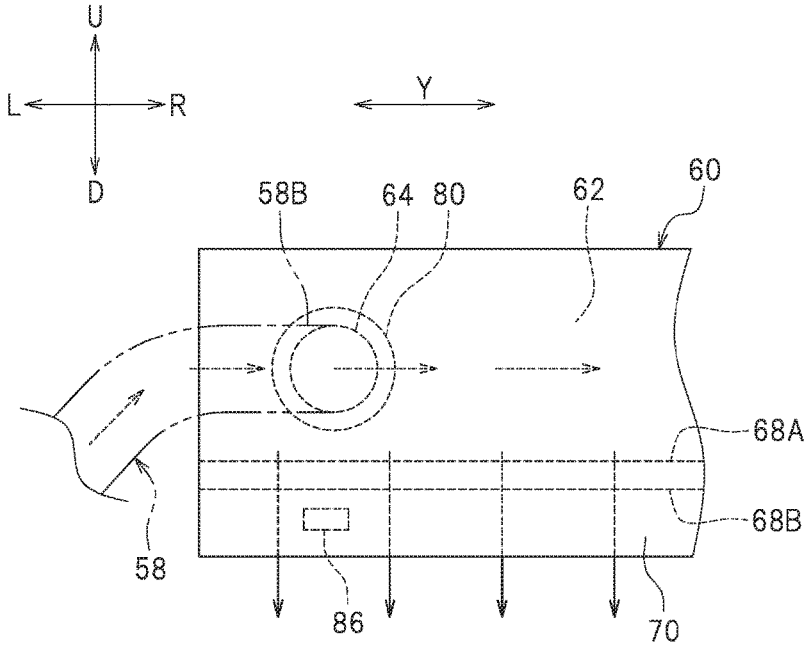
FIG. 4 is an enlarged view of a portion IV in FIG. 2 and illustrates an air blower according to a preferred embodiment of the present invention.

As illustrated in FIG. 3, the body 62 is fitted in the lower end 24B of the front cover 24. As illustrated in FIG. 4, the body 62 extends in the main scanning direction Y. Air supplied from the fan 56 is distributed in the body 62.

As illustrated in FIG. 5, while the front cover 24 is closed, the air inlet 64 is open in the subscanning direction X. The air inlet 64 may be open in the main scanning direction Y. The air inlet 64 is disposed in the body 62. As illustrated in FIG. 4, the air inlet 64 is disposed at the left end of the body 62. The air inlet 64 is disposed in a back surface 62A (see FIG. 3) of the body 62. Here, the back surface 62A of the body 62 is a portion of the surface of the body 62 located at an upstream side in the subscanning direction X and extending in the longitudinal direction (main scanning direction Y) of the body 62 while the front cover 24 is closed. While the front cover 24 is closed, the back surface 62A faces the ink head 30. On the other hand, a front surface 62B of the body 62 is a surface located at a downstream side in the subscanning direction X and extending in the longitudinal direction (main scanning direction Y) of the body 62 while the front cover 24 is closed. Air supplied from the fan (see FIG. 2) flows into the air inlet 64. Air supplied from the fan 56 flows into the body 62 through the air inlet 64 and is distributed in the body 62.

Figure 6:
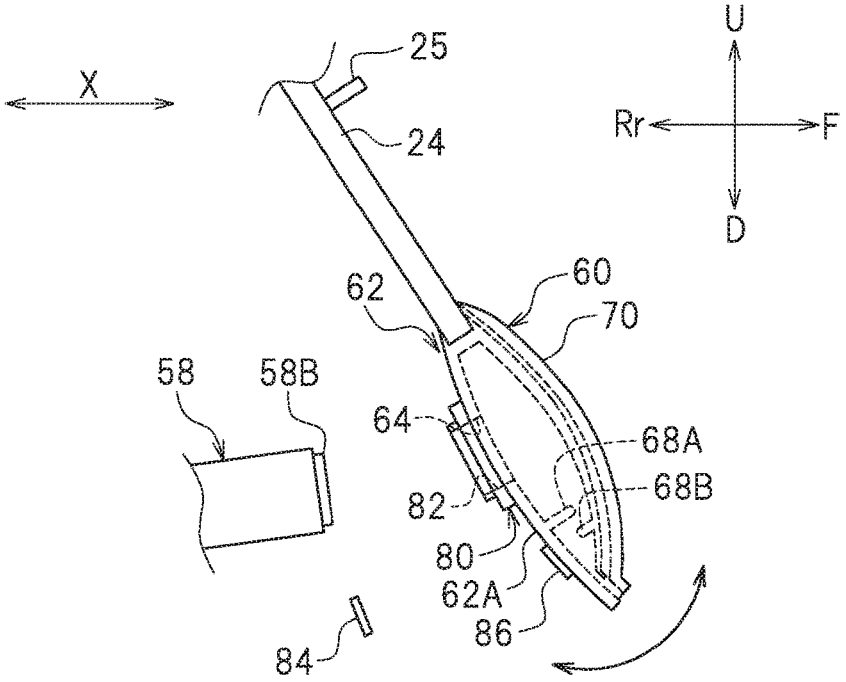
FIG. 6 is a side view illustrating a state in which a front cover according to a preferred embodiment of the present invention is open.
Figure 7:
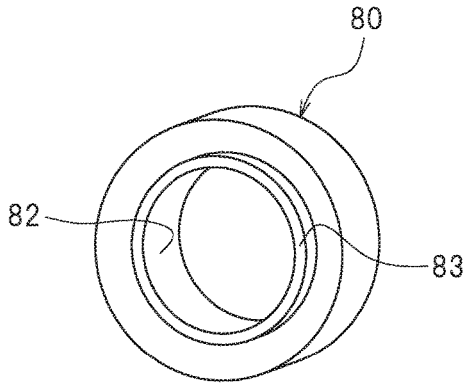
FIG. 7 is a perspective view of a coupler according to a preferred embodiment of the present invention.
Figure 8:
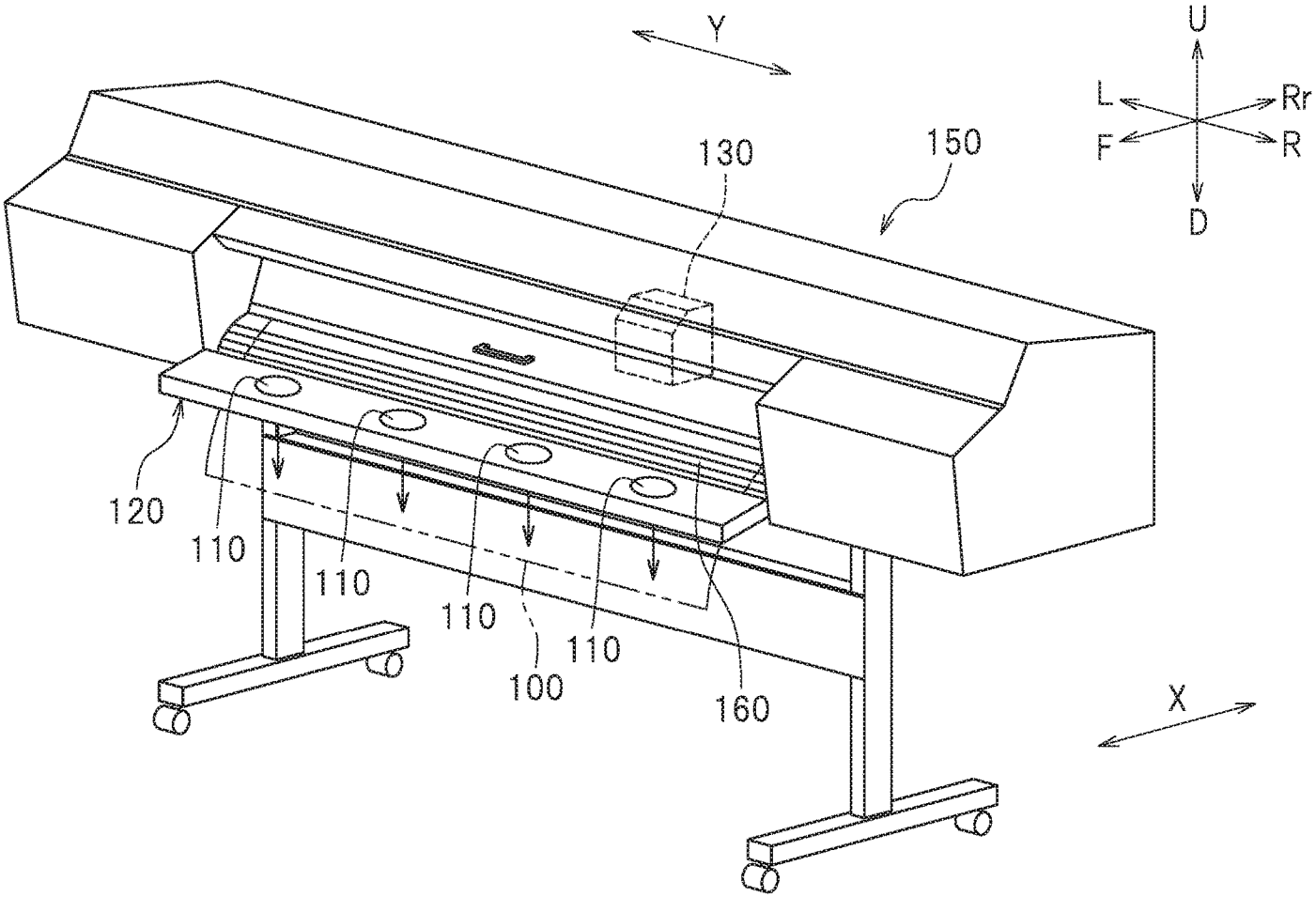
FIG. 8 PRIOR ART
FIG. 8 is a perspective view illustrating a conventional ink jet printer including an air blower.

As illustrated in FIG. 6, a coupler 80 is disposed on the back surface 62A of the body 62. The coupler 80 is preferably elastically deformable. The coupler 80 is made of, for example, rubber. As illustrated in FIG. 7, the coupler 80 has an annular shape. The coupler 80 includes a through hole 82. The through hole 82 of the coupler 80 communicates with the air inlet 64. The coupler 80 includes a projection 83 extending axially. As illustrated in FIG. 5, while the front cover 24 is closed, the second end 58B of the air distribution pipe 58 is fitted in the through hole 82. That is, while the front cover 24 is closed, the second end 58B of the air distribution pipe 58 is connected to air inlet 64 through the coupler 80. The second end 58B of the air distribution pipe 58 and the through hole 82 of the coupler 80 are fitted to each other. On the other hand, as illustrated in FIG. 6, while the front cover 24 is open, the second end 58B of the air distribution pipe 58 is not connected to the air inlet 64.

As illustrated in FIG. 3, the air outlet 66 is disposed in the body 62. The air outlet 66 is disposed in the front end of the body 62. The air outlet 66 extends in the main scanning direction Y. In this preferred embodiment, the air outlet 66 extends across the entire body 62 in the main scanning direction Y. The air outlet 66 allows air in the body 62 to be sent toward the portion 5A of the recording medium 5 placed on the platen 20 located upstream (forward) of the front cover 24 in the subscanning direction X.

As illustrated in FIG. 3, the body 62 includes the first rib 68A and the second rib 68B. The first rib 68A and the second rib 68B are provided in the body 62. The first rib 68A and the second rib 68B are disposed between the air inlet 64 and the air outlet 66. The first rib 68A and the second rib 68B are disposed downstream of the air inlet 64 in the airflow direction. The first rib 68A and the second rib 68B are disposed upstream of the air outlet 66 in the airflow direction. The first rib 68A is disposed upstream of the second rib 68B in the airflow direction. The first rib 68A projects from the back surface 62A of the body 62 toward the front surface 62B. The second rib 68B projects from the front surface 62B of the body 62 toward the back surface 62A. As illustrated in FIG. 4, the first rib 68A and the second rib 68B extend in the main scanning direction Y. The first rib 68A and the second rib 68B are provided in the entire portion of the body 62 in the main scanning direction Y. The body 62 has a labyrinth structure defined by the first rib 68A and the second rib 68B. As illustrated in FIGS. 3 and 4, air that has flowed from the air inlet 64 into the body 62 is rectified while passing between the first rib 68A and the second rib 68B, and thus, the pressure of the air becomes uniform. In this manner, air discharged from the air outlet 66 flows at a uniform flow rate over the entire air outlet 66.

As illustrated in FIG. 3, the covering portion 70 is disposed on the front surface 62B of the body 62. Space is present between the covering portion 70 and the body 62. The air suction port 72 is disposed in an upper end 70A of the covering portion 70. Here, the upper end 70A of the covering portion 70 is an upper end of the covering portion 70 while the front cover 24 is closed. Air sucked from the air suction port 72 flows between the covering portion 70 and the body 62. The air discharge port 74 is disposed in the lower end 70B of the covering portion 70. Here, the lower end 70B of the covering portion 70 is a lower end of the covering portion 70 while the front cover 24 is closed. Air flowing between the covering portion 70 and the body 62 is discharged from the air discharge port 74. Air discharged from the air discharge port 74 is merged with air discharged from the air outlet 66 of the body 62, and the resulting air flows toward the recording medium 5 placed on the platen 20. That is, since the air blower 60 includes the covering portion 70, the flow rate of air supplied to the recording medium 5 can be increased. Air sent from the air blower 60 flows obliquely downward toward the front.

As illustrated in FIG. 6, the printer 10 includes a cover-side engagement structure 84 and a device-side engagement structure 86 that engage with the cover-side engagement structure 84. The cover-side engagement structure 84 and the device-side engagement structure 86 are, for example, magnets. The cover-side engagement structure 84 is disposed on the cover 12. The cover-side engagement structure 84 is disposed above the platen 20. The cover-side engagement structure 84 is attached to a bracket (not shown) disposed on the left side cover 18L, for example. The device-side engagement structure 86 is disposed on the air blower 60. The device-side engagement structure 86 is disposed on the back surface 62A of the body 62. The device-side engagement structure 86 is disposed closer to the air outlet 66 than the air inlet 64 is. As illustrated in FIG. 5, while the front cover 24 is closed, the cover-side engagement structure 84 and the device-side engagement structure 86 are engaged with each other.

As described above, in the printer 10, the air blower 60 that supplies air to the recording medium 5 placed on the platen 20 is disposed on the front cover 24. Here, the front cover 24 is attached to the cover 12 so as to open and close the opening 14 located downstream of the ink head 30 in the subscanning direction X. Thus, in placing the recording medium 5 on the platen 20, when the operator opens the front cover 24, the air blower 60 moves accordingly together with the front cover 24. In this manner, when the front cover 24 is open, the air blower 60 is not located downstream (forward) of the platen 20 in the subscanning direction X.

Accordingly, the operator is able to place the recording medium 5 on the platen 20 without interruption of the air blower 60.

In the printer 10 according to this preferred embodiment, the air blower 60 supplies air toward a portion of the recording medium 5 downstream of the front cover 24 in the subscanning direction X. Thus, air supplied from the air blower 60 is not diffused toward the ink head 30. In this manner, ink ejected from the ink head 30 is able to hit an appropriate position on the recording medium 5 and promote drying of the ejected ink.

In the printer 10 according to this preferred embodiment, the air blower 60 is disposed on the lower end 24B of the front cover 24. Accordingly, the distance between the air blower 60 and the recording medium 5 is able to be reduced, and as a result, air supplied from the air blower 60 is able to be efficiently sent to the recording medium 5.

In the printer 10 according to this preferred embodiment, the cover 12 includes the upper cover 16 disposed above the platen 20 and the left side cover 18L disposed at the left of the platen 20. In the left side cover 18L, the fan 56 that supplies air to the air blower 60 is disposed. Since the fan 56 is able to be provided separately from the air blower 60, the fan 56 is able to be designed to have a relatively large size.

In the printer 10 according to this preferred embodiment, the air outlet 66 extends in the main scanning direction Y. Accordingly, air supplied from the fan 56 is able to be sent to a wider range of the recording medium 5.

In the printer 10 according to this preferred embodiment, the air blower 60 is disposed inside the body 62 and between the air inlet 64 and the air outlet 66, and includes the first rib 68A and the second rib 68B both extending in the main scanning direction Y. This structure further uniformizes the pressure of air guided from the body 62 to the air outlet 66 through the first rib 68A and the second rib 68B and, thus, further uniformizes the flow rate of air discharged from the air outlet 66.

In the printer 10 according to this preferred embodiment, while the opening 14 is closed by the front cover 24, the second end 58B of the air distribution pipe 58 is connected to the air inlet 64. In general, while the front cover 24 is open, no ink is ejected from the ink head 30 onto the recording medium 5, and thus, no air needs to be supplied to the recording medium 5. Therefore, the configuration in which the second end 58B of the air distribution pipe 58 is connected to the air inlet 64 while the front cover 24 is closed, supply of unnecessary air from the air blower 60 is avoided.

In the printer 10 according to this preferred embodiment, while the opening 14 is closed by the front cover 24, the second end 58B of the air distribution pipe 58 is fitted into the coupler 80 that communicates with the air inlet 64. This configuration further ensures reduction of leakage of air supplied from the fan 56 in a portion where the air distribution pipe 58 and the body 62 are connected to each other.

In the printer 10 according to this preferred embodiment, the air inlet 64 may open in the main scanning direction Y and the fan 56 and the air inlet 64 may be arranged side by side in the main scanning direction Y. In this manner, air supplied from the fan 56 is more smoothly guided into the body 62.

In the printer 10 according to this preferred embodiment, while the opening 14 is closed by the front cover 24, the cover-side engagement structure 84 and the device-side engagement structure 86 are engaged with each other. This structure reduces or prevents disconnection between the second end 58B of the air distribution pipe 58 and the air inlet 64.

The foregoing description is directed to preferred embodiments of the present invention. The preferred embodiments described above, however, are merely examples, and the present invention can be performed by and include various other preferred embodiments.

In the preferred embodiments described above, the fan 56 preferably is disposed inside the left side cover 18L. The present invention, however, is not limited to this example. The fan 56 may be disposed inside the right side cover 18R. In this case, the air inlet 64 is preferably disposed at the right end of the body 62.

In the preferred embodiments described above, the air blower 60 includes the covering portion 70, but may include only the body 62 without including the covering portion 70.

In the preferred embodiments described above, the body 62 preferably includes two first and second ribs 68A and 68B. Alternatively, one rib may be provided, or three or more ribs may be provided. The shape and the size of such ribs and the density where the ribs are provided (i.e., the number of ribs in a unit area) may vary depending on the location of the ribs. The ribs may extend at any intended direction.

In the preferred embodiments described above, the cover-side engagement structure 84 and the device-side engagement structure 86 preferably are magnets, but the present invention is not limited to this example. The cover-side engagement structure 84 and the device-side engagement structure 86 may be shaped in such a manner that the cover-side engagement structure 84 includes an insertion hole and the device-side engagement structure 86 includes a projection that is engageable with the insertion hole.

In the printer 10 described above, a heater to heat air supplied from the fan 56 may be provided downstream of the fan 56 and upstream of the air outlet 66 in the airflow direction. In this case, heated air is able to be supplied from the air blower 60 so that ink ejected onto the recording medium 5 can be more efficiently dried. For example, the heater may be disposed inside the left side cover 18L and between the fan 56 and the air distribution pipe 58. The heater may be disposed around the air distribution pipe 58 to heat air through the air distribution pipe 58.

The terms and expressions used herein are for description only and are not to be interpreted in a limited sense. These terms and expressions should be recognized as not excluding any equivalents of the elements shown and described herein and as allowing any modification encompassed in the scope of the claims. The present invention may be embodied in many various preferred embodiments and forms. This disclosure should be regarded as providing preferred embodiments of the principle of the present invention. These preferred embodiments are provided with the understanding that they are not intended to limit the present invention to the preferred embodiments described in the specification and/or shown in the drawings. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or referred to during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An ink jet printer comprising:

a platen on which a recording medium is able to be placed;

an ink head that is movable in a main scanning direction and ejects ink onto the recording medium;

a conveyor that conveys the recording medium in a subscanning direction perpendicular or substantially perpendicular to the main scanning direction;

a cover disposed above and to at least a side of the platen and including an opening located downstream of the ink head in the subscanning direction;

a front cover that is attached to the cover and opens and closes the opening; and an air blower disposed on the front cover.

2. The ink jet printer according to claim 1, wherein the air blower supplies air to a portion of the recording medium placed on the platen, the portion being located downstream of the front cover in the subscanning direction.

3. The ink jet printer according to claim 1, wherein the air blower is disposed at a lower end of the front cover.

4. The ink jet printer according to claim 1, wherein the cover includes a first cover portion disposed above the platen and a second cover portion disposed at a side of the platen; and a fan that supplies air to the air blower is disposed in the second cover portion.

5. The ink jet printer according to claim 4, wherein the air blower includes:

a body extending in the main scanning direction and allowing air supplied from the fan to be distributed therein;

an air inlet which is disposed in the body and into which air supplied from the fan flows; and an air outlet disposed in the body and extending in the main scanning direction to discharge air in the body toward a portion of the recording medium placed on the platen, the portion being located downstream of the front cover in the subscanning direction.

6. The ink jet printer according to claim 5, wherein the air blower is disposed in the body and between the air inlet and the air outlet, and includes a rib extending in the main scanning direction.

7. The ink jet printer according to claim 5, further comprising:

an air distribution pipe including a first end connected to the fan and a second end connectable to the air inlet, the air distribution pipe allowing air supplied from the fan to flow in the air distribution pipe; wherein while the opening is closed by the front cover, the second end of the air distribution pipe and the air inlet are connected to each other.

8. The ink jet printer according to claim 7, further comprising:

an elastically deformable coupler communicating with the air inlet and having an annular shape; wherein while the opening is closed by the front cover, the second end of the air distribution pipe is fitted in the coupler.

9. The ink jet printer according to claim 5, wherein the air inlet is open in the main scanning direction; and the fan and the air inlet are arranged side by side in the main scanning direction.

10. The ink jet printer according to claim 5, further comprising:

a cover-side engagement structure provided with the cover; and a device-side engagement structure provided with the air blower; wherein while the opening is closed by the front cover, the cover-side engagement structure and the device-side engagement structure are engaged with each other.

11. The ink jet printer according to claim 4, further comprising a heater disposed downstream of the fan and upstream of the air outlet in an airflow direction to heat air supplied from the fan.

* * * * *